United States Patent [19]

Bernazzani

[11] 4,092,973

[45] June 6, 1978

[54] FIELD RANGE CABINET

[75] Inventor: Richard J. Bernazzani, Roslindale, Mass.

[73] Assignee: The United States of America as represented by the Secretary of the Army, Washington, D.C.

[21] Appl. No.: 678,503

[22] Filed: Apr. 19, 1976

[51] Int. Cl.[2] ..... F24C 15/10; A47B 77/01; A47F 3/04

[52] U.S. Cl. ..... 126/37 B; 126/9 R; 126/37 R; 126/37 A; 126/39 B; 126/39 C; 312/237; 312/317 R

[58] Field of Search ..... 312/236, 257 SK, 257 SM, 312/257 A, 265, 349, 270, 271; 126/9 R, 37 R, 37 A, 37 B, 275 R, 39 B, 39 C, 29, 275, 30, 39 M, 9 B; 220/4 F

[56] References Cited

U.S. PATENT DOCUMENTS

| | | | |
|---|---|---|---|
| D. 116,807 | 9/1939 | Russell et al. | 126/37 R X |
| 1,156,773 | 10/1915 | Gordon | 126/9 R |
| 1,228,367 | 5/1917 | O'Dowd | 126/275 R |
| 1,247,806 | 11/1917 | Ferdon | 126/9 R |
| 1,345,824 | 7/1920 | Bayless | 126/275 R |
| 1,987,378 | 1/1935 | Tansley | 126/39 B |
| 2,391,460 | 12/1945 | Howard | 126/29 X |
| 3,354,878 | 11/1967 | Balls | 126/275 R |

FOREIGN PATENT DOCUMENTS

| | | | |
|---|---|---|---|
| 100,419 | 3/1937 | Australia | 126/9 R |
| 891,343 | 3/1944 | France | 126/39 B |
| 849,302 | 9/1960 | United Kingdom | 126/121 |

*Primary Examiner*—William F. O'Dea
*Assistant Examiner*—Harold Joyce
*Attorney, Agent, or Firm*—Nathan Edelberg; Robert P. Gibson; Charles C. Rainey

[57] ABSTRACT

A field range, primarily for cooking out-of-doors, comprising a removable outer shell capable of easy and quick locking and unlocking with respect to the frame of the field range cabinet and easy removal from the frame to facilitate cleaning of the interior walls of the field range oven and the horizontal and vertical support elements of the frame.

1 Claim, 6 Drawing Figures

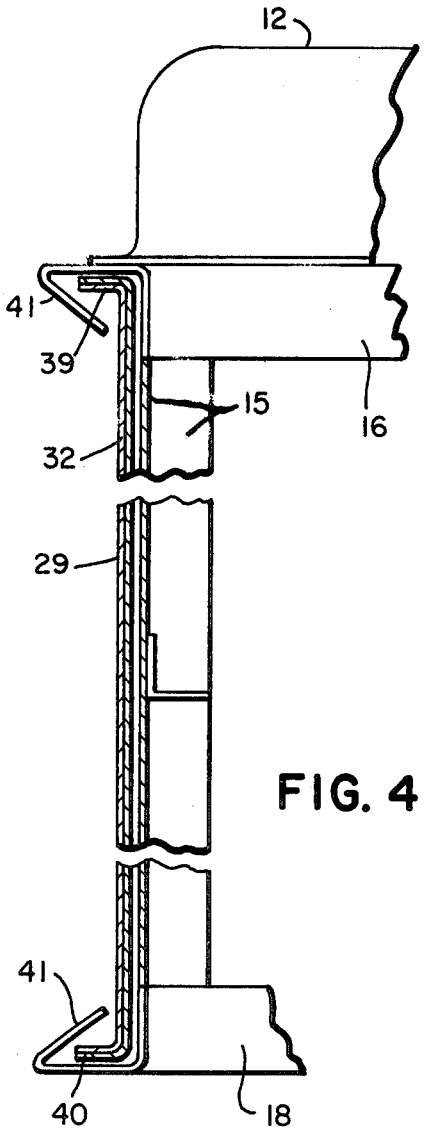
FIG. 4
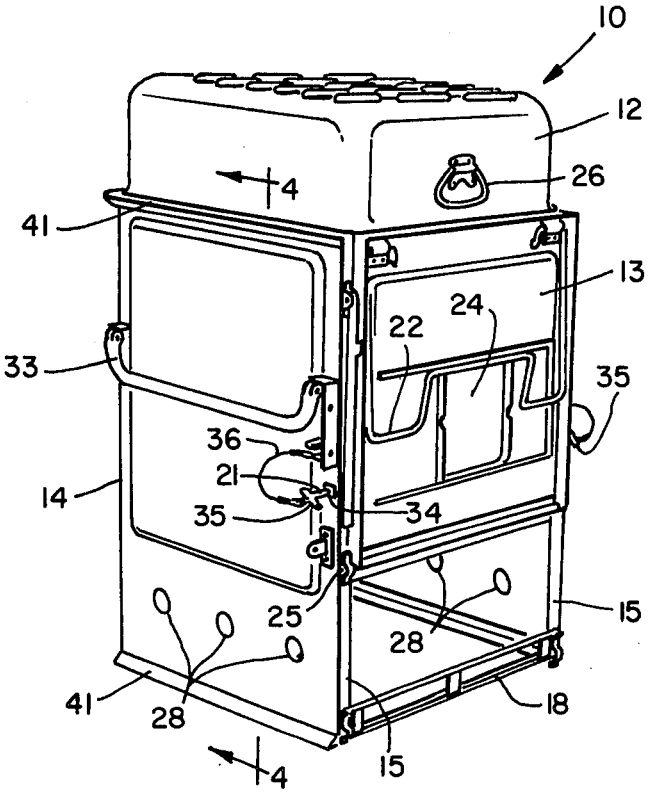
FIG.3
FIG. 5
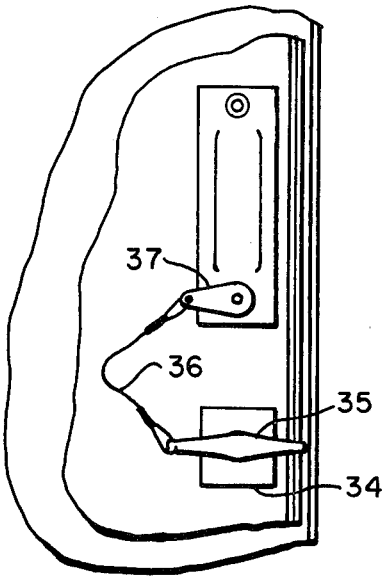
FIG.6
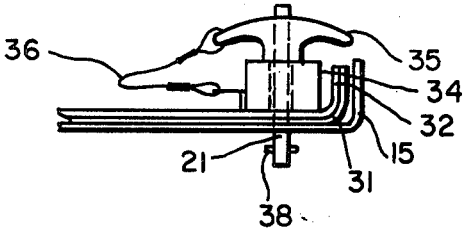

FIELD RANGE CABINET

The invention described herein may be manufactured, used, and licensed by or for the Government for governmental purposes without the payment to me of any royalty thereon.

BACKGROUND OF THE INVENTION

This invention relates to an improved field range cabinet wherein the two side walls and the rear wall within which the burner and oven portions of the field range are enclosed are formed into a single removable outer shell element which slidably cooperates with the frame of the range to make the interior of the range more easily accessible for cleaning than has been characteristic of field ranges of the prior art.

Field ranges for the military have customarily comprised a cabinet composed of a frame, a lid attached to the upper back edge of the frame by means of a pair of hinges, a door connectd to the front of the frame by means of a hinge and a pair of folding struts which help to support the opened door in a horizontal position, two side panels permanently attached to the frame, and a rear panel permanently attached to the frame. The frame has horizontal angle irons attached thereto to support a gasoline burner and to support a large cooking or heating vessel or a metallic shelf above the gasoline burner.

In the past a big problem in connection with feeding programs in the Armed Forces has been the cleaning of the interior surfaces of the standard field range. This has been complicated by the fact that there is relatively little space between the angle irons of which the frame is made and the interior surfaces of the walls of the oven portion of the field range. This space is sufficient to permit the volatile materials and spatterings produced in the oven to work their way into the space and be carbonized or polymerized to form tarry deposits on the surfaces. But the space is so small that it is extremely difficult to apply cleaning agents to the deposits and to insert the fingers or brushes or scraping tools therein for the purpose of removing such deposits.

It is an object of the present invention to provide means for simplifying and for speeding up cleaning and for making cleaning of the interior surfaces of field ranges more effective, particularly for accomplishing these objectives in the cleaning of the sidewalls and rear wall of the oven portions of such ranges.

Other objects and advantages will become apparent from the following description of the invention.

SUMMARY OF THE INVENTION

A removable outer shell for a field range cabinet, comprising two sidewall elements and a rear wall element joined together to form a unitary rear and side enclosure for the frame and oven elements of the field range. Each of the removable outer shell sidewall and rear elements is constructed of an inner stainless steel lamina and an outer aluminum lamina, the unitary, removable outer shell sliding easily into position to be locked to the frame or to be unlocked and removed from connection with the frame, thus providing easy access to all of the interior surfaces which are prone to collect spatterings of food thereon or deposits formed by condensation of volatiles from food cooked in the field range oven and by decomposition of such condensates as well as the food spatterings. Quick lock elements are employed to maintain the removable outer shell firmly locked to the frame of the field range when the latter is in operation. They can be quickly unlocked, allowing the removable outer shell to be slid backward on runners along the bottom side edges of the frame and completely separated from the frame and other elements of the field range.

DESCRIPTION OF THE PREFERRED EMBODIMENT

The invention will be more fully understood by reference to the following description of one embodiment of the invention taken in conjunction with the accompanying drawings, in which:

FIG. 3 is a perspective view of the assembled modified field range with the removable outer shell in place on the frame of the field range cabinet and locked to the frame at both sides, the door and lid being shown in their closed positions for operation of the oven.

FIG. 4 is a vertical sectional view, partially broken away, taken along plane 4—4 of FIG. 3 through the removable outer shell and the frame of the field range cabinet on the left side, as viewed from the front of the field range.

Figure 1:
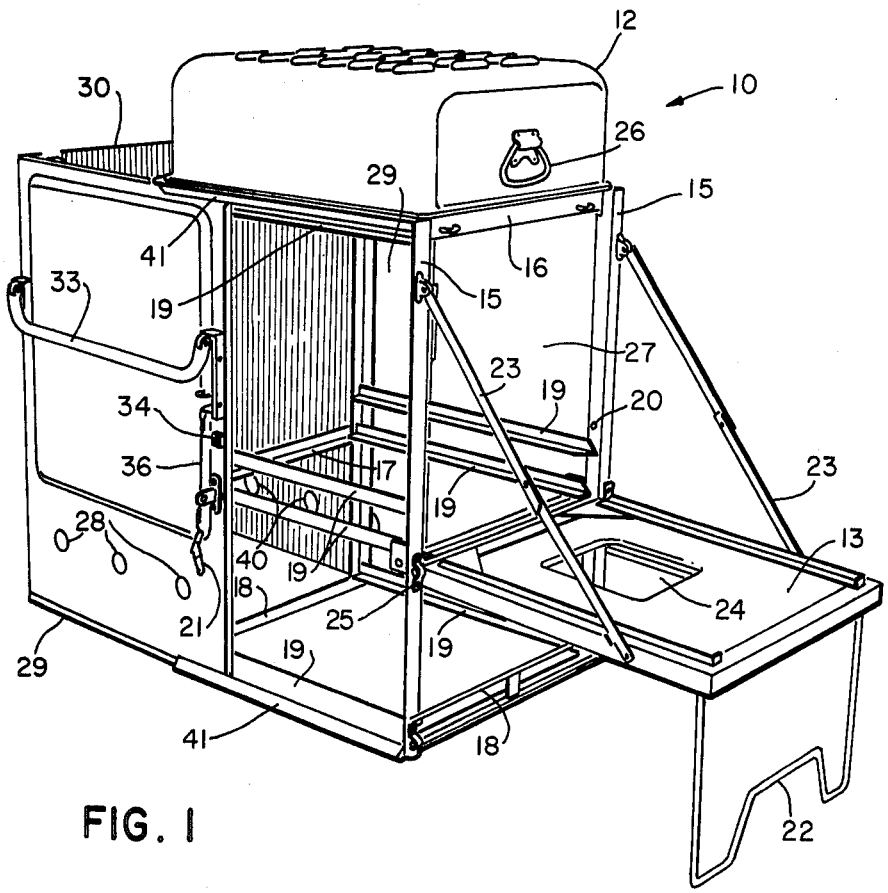
FIG. 1 is a perspective view of a field range modified in accordance with the invention, the removable outer shell being shown partially removed from the frame of the field range cabinet, the door being shown in the open position while the lid is in its closed position.

FIG. 5 is a view in elevation, partially broken away, of the handle of the locking pin and the block attached to the outer surface of one of the side walls of the removable outer shell through which the locking pin passes and thence passes through the side wall and into a hole in the frame, thereby locking the removable outer shell to the frame on that side, there being a duplicate locking pin and associated elements on the other side of the removable outer shell, as shown in FIG. 3.

FIG. 6 is a plan view of the locking pin, locking pin handle, and block through which the locking pin passes, similar to those elements as shown in FIG. 5, but looking from below the locking pin and block in an upward direction, the removable outer shell and the frame being broken away.

Referring to the drawings, the field range, generally designated by reference numeral 10, comprises a frame 11, a lid 12, a door 13, and a removable outer shell 14. The frame constitutes the supporting structure for the other elements of the field range, including the burner for heating the oven, which is not shown since it is not a part of the invention and various types and constructions of heating equipment may be employed. The frame comprises vertical angle irons 15 at the four corners thereof, top horizontal angle irons 16, middle horizontal angle iron 17 and bottom horizontal angle irons 18 which are attached to the vertical angle irons 15 by welding or other suitable means to form a generally square cross section in horizontal planes. At the bottom and at intermediate positions between the top horizontal angle irons and the bottom horizontal angle irons the frame has pairs of side horizontal angle irons 19 attached by welding or other suitable means to the vertical angle irons so as to provide supports along both sides running from front to rear of the range, each pair of side horizontal angle irons providing a narrow shelf or flange along each side of the range at substantially equal heights to serve as supports for a burner or for a cradle to support a stockpot or for metallic shelves on which bread or cakes or other types of food may be supported above a burner during baking or other cooking operations. The front vertical angle iron on each side has a hole 20 passing therethrough for receiving the end of a locking pin 21, the function of which will be described below in connection with the description of the removable outer shell 14.

The door 13 is provided with a door rest 22 which swivels so that when the door is closed, the door rest lies against the exterior surface of the door, and when opened, the door rest supports the door along its upper edge while stays 23, which are hinged at about their midpoints, also help to support the door in the horizontal open position. The door also contains a shuttered window 24 through which the interior of the oven of the field range may be viewed while the door is closed by moving the shutter to one side to uncover the window. The door is connected to the two front vertical angle irons by means of hinges 25.

The lid 12 is hinged at the rear (hinges not shown) so that it may be lifted by means of handle 26 to open up the top of the frame to permit the seating of a grill or various types of food or liquid heating surfaces or vessels at the top of the frame. Depending on the type of heating or cooking being carried out and the depth of the vessel seated at the top of the frame, the lid may or may not be closed during such heating. If the range is being used as an oven, the lid will usually be closed to hold in the heat generated below the oven section, which is generally represented by reference numeral 27 and may be of varying depth depending on the height of the burner and the location of the lowest shelf.

The removable outer shell 14 provides the means for closing the sides and rear of the oven section of the field range as well as for largely closing the section below the oven section along the two sides and the rear, with the exception of vent holes 28, which allow additional air to get into the lower section over that which migrates in through the open front below the door. It is necessary for adequate air to be able to migrate in around the burner to provide the oxygen required to oxidize the fuel used in the burner.

The removable outer shell comprises two side walls 29 and a rear wall 30, the rear wall being joined approximately perpendicularly to each of the side walls and separating them one from the other by a distance substantially equal to the width of the field range frame and, therefore, the width of the oven section as well as the lower (burner) section. As shown in FIG. 4, showing the left side wall 29 and the vertical angle iron 15 of the frame in vertical section, the side walls 29 comprise an inner skin 31 which is preferably made of stainless steel sheet and an outer skin 32 which is preferably made of aluminum sheet, the stainless steel and aluminum sheets being riveted or spot welded together or held together by crimping along the edges. The rear wall 30 is similarly constructed, thus providing stainless steel interior surfaces along both sides and the rear of the oven when the removable outer shell is in its operating position and making possible easy cleaning of the interior surfaces when the removable outer shell is removed from the frame, as shown in FIG. 2.

Each side wall 29 has a lifting handle 33 which swivels at both ends thereof so that, when the removable outer shell is not being disengaged and removed from the frame or being re-engaged therewith after having been disengaged for cleaning thereof as well as cleaning of the frame components, the lifting handle lies flat against the outer skin of the side wall to which it is attached. Each side wall also has a block 34 welded or otherwise attached to the outer skin thereof which has a hole passing therethrough and through the side wall of sufficient diameter to receive locking pin 21, which passes through block 34, side wall 29 and hole 20 in vertical angle iron 15 to lock the removable outer shell to the frame on each side of the field range. Each locking pin 21 has a handle 35 which is grasped and used to insert locking pin 21 into block 34 and hole 20 in the vertical angle iron or to withdraw the locking pin therefrom when it is desired to disengage the removable outer shell from the frame for cleaning purposes. The handle 35 is attached to cable 36 which in turn is attached to bracket 37 to prevent loss of the locking pin when it is removed from its normal operating position passing through block 34 and hole 20. Locking pins 21 have spring-biased retractable buttons 38 which offer sufficient resistance against retraction to prevent the accidental disengagement of the locking pins, particularly when the field range is being transported by truck.

As may be seen, particularly in FIG. 4, each side wall is provided with a top flange 39 and a bottom flange 40 extending the full span of the side wall. These flanges glide within upper and lower runners on the sides of the frame formed by bent over flanges 41 welded or otherwise fastened to side horizontal angle irons 19 extending from front to rear of the field range and to top horizontal angle irons 16 and bottom horizontal angle irons 18 and vertical angle irons 15 along both the top side edges and bottom side edges, respectively.

Figure 2:
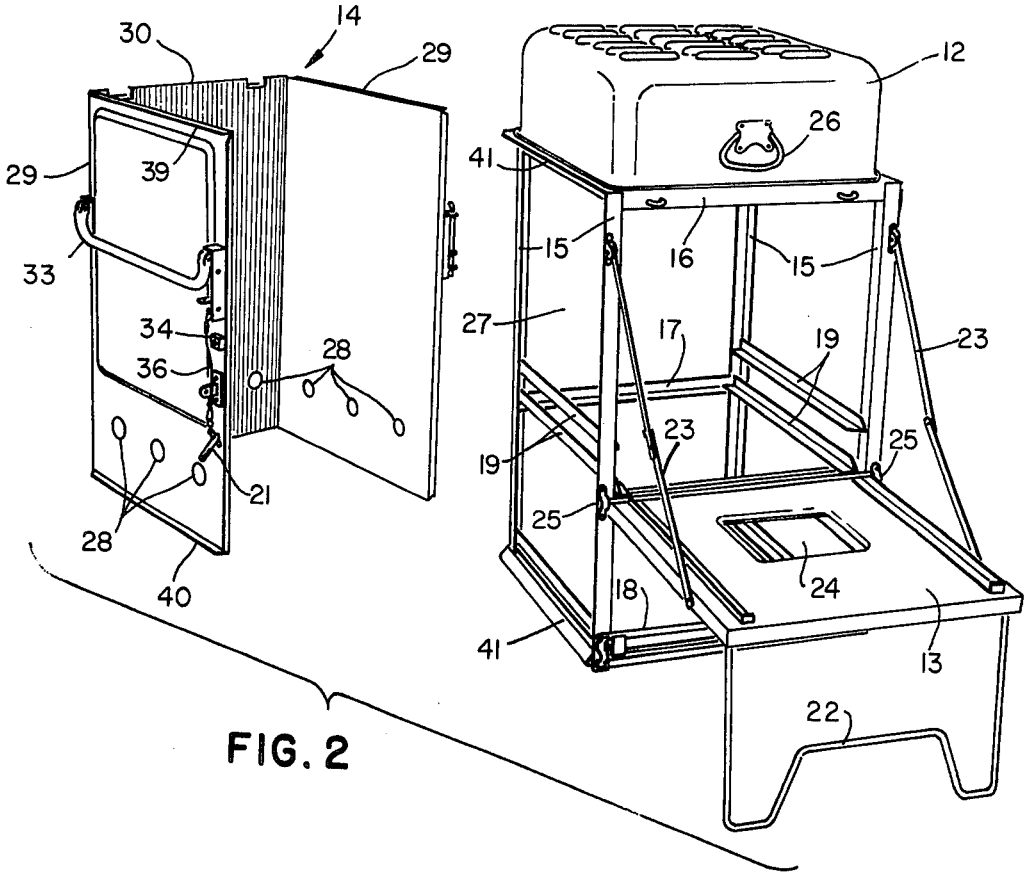
FIG. 2 is an exploded perspective view of the field range with the outer shell completely separated from the frame portion of the field range cabinet while the door and lid remain attached to the frame, the door being shown in the open position while the lid is shown in its closed position, as in FIG. 1.

In the use or operation of the invention, starting from the situation shown in FIG. 2 in which the removable outer shell is separated from the frame of the field range, the removable outer shell is lifted by means of lifting handles 33 and brought up to the rear of the field range; then the flanges 39 and 40 are slid into place behind bent over flanges 41 so that the removable outer shell passes through the situation shown in FIG. 1 progressively toward the situation shown in FIG. 3, the engagement of the removable outer shell with the field range frame being completed by inserting locking pins 21 in both sides of the removable outer shell and the holes 20 in the vertical angle irons 15. After a baking or other cooking session using the field range, and when it is desired to clean the interior of the oven and other portions of the field range, the above-recited procedure is reversed, unlocking the removable outer shell from the frame, sliding the removable outer shell toward the rear of the field range, and finally lifting it to a position spaced from the frame of the field range as shown in FIG. 2. Then all of the surfaces which were within the oven or within the burner compartment below the oven are easily accessible for cleaning, thus permitting much more efficient cleaning of these surfaces than has heretofore been possible with field ranges of the prior art.

I wish it to be understood that I do not desire to be limited to the exact details described, for obvious modifications will occur to a person skilled in the art.

I claim:

1. In a cooking range for use in the field which comprises a cabinet frame, a hinged front door, a hinged lid, and cabinet outer shell side and rear walls, the improvements which comprise a unitary, U-shaped, outer shell, said outer shell being removable from said cabinet frame, said cabinet frame having flanged upper and lower edges on both sides thereof forming upper and lower runners along the upper and lower edges of both sides of said cabinet frame, said outer shell comprising two side walls separated from each other and being joined by a rear wall and having flanged upper and lower edges on both sides thereof, said flanged upper and lower edges of both sides of said outer shell cooperating with said upper and lower runners formed by said flanged upper and lower edges of the sides of said cabinet frame for slidably engaging said outer shell with said cabinet frame to permit operation of said cooking range and for slidably disengaging said outer shell from said cabinet frame to facilitate cleaning all of the surfaces exposed to food and vapors from food inside of said cooking range during operation thereof, said outer shell comprising means on both sides thereof for locking said outer shell side walls to said cabinet frame during operation of said cooking range and for unlocking said outer shell side walls from said cabinet frame, whereby said outer shell becomes slidably disengageable from said cabinet frame.

* * * * *